US005736210A

United States Patent [19]

Treleaven

[11] Patent Number: 5,736,210

[45] Date of Patent: Apr. 7, 1998

[54] LABEL AND METHOD FOR FORMING A LABEL FROM DOUBLE COATED TAPE

[75] Inventor: Carl W. Treleaven, Greensboro, N.C.

[73] Assignees: Pharmagraphics (Midwest), L.L.C.; Pharmagraphics (Southeast), L.L.C., both of Greensboro, N.C.

[21] Appl. No.: 259,856

[22] Filed: Jun. 15, 1994

[51] Int. Cl.[6] ..... G09F 3/02

[52] U.S. Cl. ..... 428/40.1; 281/2; 281/5; 283/81; 428/42.2; 428/42.3; 428/194; 428/212; 428/914

[58] Field of Search ..... 428/40, 194, 212, 428/914; 281/5, 2; 283/81

[56] References Cited

U.S. PATENT DOCUMENTS

| | | | |
|---|---|---|---|
| 3,032,463 | 5/1962 | Morgan | 156/253 |
| 3,166,186 | 1/1965 | Karn | 206/56 |
| 3,558,388 | 1/1971 | Somerville | 156/108 |
| 4,475,969 | 10/1984 | Reed | 156/152 |
| 4,488,922 | 12/1984 | Instance | 156/192 |
| 4,661,189 | 4/1987 | Voy et al. | 156/248 |
| 4,675,062 | 6/1987 | Instance | 156/227 |
| 4,711,686 | 12/1987 | Instance | 156/227 |
| 4,822,445 | 4/1989 | Yamaguchi | 156/510 |
| 4,894,106 | 1/1990 | Instance | 156/227 |
| 4,991,878 | 2/1991 | Cowan | 283/81 |
| 5,021,273 | 6/1991 | Kobayashi | 428/40 |
| 5,262,214 | 11/1993 | Instance | 428/40 |
| 5,380,576 | 1/1995 | Christensen | 428/354 |
| 5,449,538 | 9/1995 | Denny | 281/2 |

FOREIGN PATENT DOCUMENTS

WO90/14218 11/1990 WIPO .

*Primary Examiner*—Nasser Ahmad

*Attorney, Agent, or Firm*—Rhodes, Coats & Bennett, L.L.P.

[57] ABSTRACT

A label product including a web of double coated tape and a plurality of outserts affixed thereto. The web of double coated tape includes a release liner having an upper surface and a carrier having an upper surface and a lower surface. The lower surface of the carrier is coated with a first adhesive layer and the upper surface of the carrier is coated with a second adhesive layer. The carrier is releasably secured to the upper surface of the release liner by the first adhesive layer and the outserts are positioned in spaced relation to one another along the web.

9 Claims, 4 Drawing Sheets

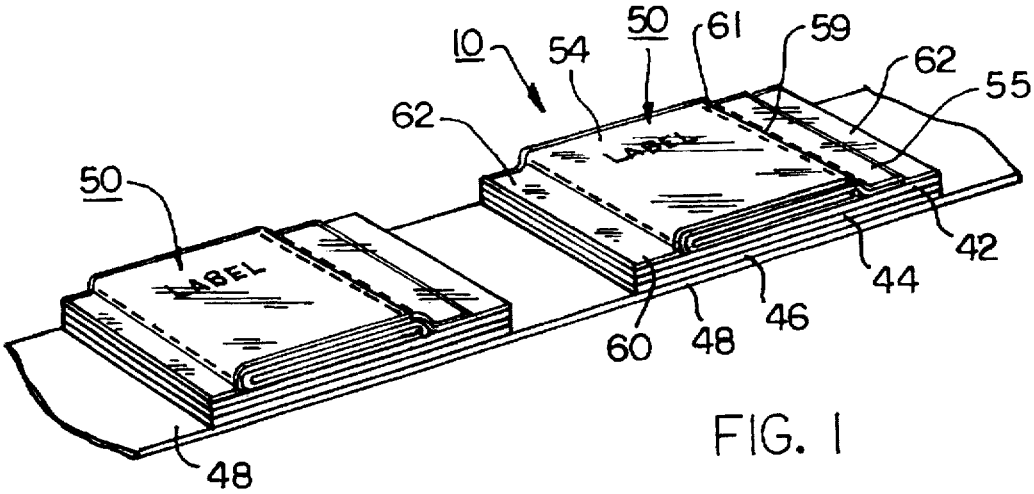
FIG. 1
FIG. 2
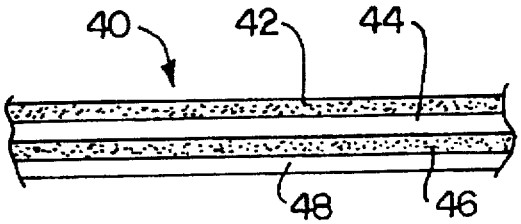
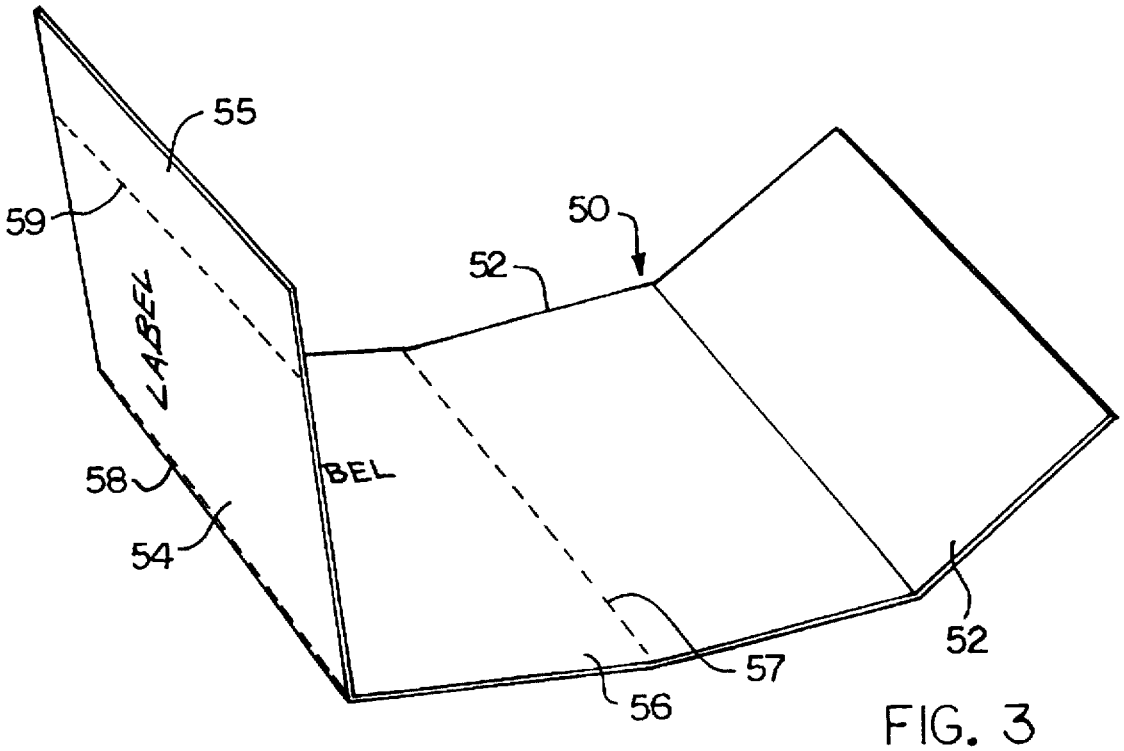
FIG. 3

LABEL AND METHOD FOR FORMING A LABEL FROM DOUBLE COATED TAPE

FIELD OF THE INVENTION

The present invention is directed to a package label and method of forming a package label, and, more particularly, to an adhesive backed label having an outsert carried thereon and a method for forming the same from a double coated adhesive tape.

BACKGROUND OF THE INVENTION

In the packaging of certain chemicals and pharmaceuticals, the manufacturer is often required or desires to provide a considerable amount of information concerning the chemical or pharmaceutical. In the case of chemicals and pharmaceuticals, this is required by government regulations. However, the occasion may also arise, either separate from or in conjunction with government regulations, to provide the doctor, pharmacist or user with instructions on how the product should be used, what the product is, and safety precautions which should be followed in the use of the product. Sometimes the literature, which is generally in the form of folded leaflets, is placed within a box along with the container carrying the chemical or pharmaceutical (referred to as "inserts"). At the same time, in addition to the insert, a primary label must be applied to the outside of the package to remain therewith. This requires a second assembly operation. The placement of leaflets within the box is expensive and a cumbersome operation to perform. Also, it is difficult as well as expensive to insure by later inspection that the proper literature has been inserted in the proper package.

A different approach to solving this problem has developed over the last several years in which the folded literature or leaflets are releasably attached to the face of the container (referred to as "outserts"), either directly to the container itself, or to a base label which, in turn, is secured to the container. The literature may then be removed by the customer. In many of such cases, the portion of the label remaining on the container must carry both an "identification" of the product defined as information such as trademark and/or product identification number, manufacturer and location, etc., as well as certain "statutory information" (defined as lot number and expiration date).

Thus, in order to meet the objectives of such labeling techniques, certain criteria must be met. First of all, the portion of the label which remains after the folded literature is removed must contain both the identification of the product, as well as the statutory information concerning the lot number and expiration date. Further, after the literature leaflet is assembled or affixed to the base label, the indicated area for statutory information concerning lot number and expiration date must be accessible for stamping or printing by the pharmaceutical company at the time the pharmaceutical product is manufactured and packaged. This information must be visible to the consumer in addition to the identification of the product. The folded leaflet portion remains affixed to the label portion until the customer (doctor, pharmacist, consumer) desires its removal. It is critical that the proper literature must be affixed to the proper base label. Finally, all of the above criteria must be accomplished in a manufacturing technique that insures quality and is cost-effective.

Examples of types of labels in the prior art which have addressed some of these criteria are described in U.S. Pat. Nos. 1,273,105 to VanDyke et al.; 4,621,837 to Mack; and 4,323,608 to Denny et al. They are examples of labels which have removable portions thereto.

In U.S. Pat. Nos. 5,207,746 and 5,263,743 to Jones, there are disclosed label constructions whereby the underlying base label is eliminated. The literature, base label, and area for statutory information are all combined into a unitary or integral product. The label constructions as disclosed therein have a bottom identification panel which is adhered to a package by means of a pressure sensitive adhesive coating on its underside. To facilitate handling, the labels are preferably mounted on a silicone coated release liner.

Three methods are known for applying adhesive to a folded leaflet or to the underside of a separate base label as taught in the prior art. An adhesive patch may be applied to the upper surface of a release liner followed by the placement of an outsert or base label thereon. Alternatively, adhesive may be applied to the underside of the bottom panel of the outsert or to the underside of the base label followed by the placement of the outsert or base label onto the release liner. Finally, a continuous layer of adhesive may be applied to the release liner followed by the placement of outserts or base labels thereon.

Each of the above-described methods for applying pressure sensitive adhesive suffers significant drawbacks and limitations. For the first two methods, it is generally necessary to coordinate the application of adhesive and bottom panels or base labels to insure proper registration. If patches of adhesive are used, they must be completely covered by the outserts or base label to avoid binding when the strip of labels is ultimately rewound and unwound. Where adhesive is applied on the underside of the bottom panel or base label, it is necessary to stop applying when an outsert or base label is not in place to avoid applying adhesive over the work area.

If a continuous strip of adhesive is applied to the release liner, either a continuous base stock must be applied or the adhesive must be die cut and the waste matrix removed prior to placement of the base labels or outserts thereon. If the adhesive is die cut, then the outsert or base label placement must be coordinated as discussed above with regard to adhesive patches.

Thus, there exists a need for a method for forming pressure sensitive adhesive backed labels mounted on a release liner which does not require an adhesive applying station. Furthermore, there exists a need for such a label construction method wherein the bottom panel of an outsert becomes adhesive coated and is designed to remain with the associated package as a primary label when the remainder of the outsert is removed.

SUMMARY OF THE INVENTION

The present invention is directed to a pressure sensitive adhesive backed outsert and a method for forming the same. According to the present invention, the leaflets or outserts are temporarily affixed to what is known as "double coated tape". Double coated tape, as used herein, includes a silicone release liner and a first layer of adhesive covered by a carrier which is in turn coated with a second adhesive layer. The first layer of adhesive is releasably mounted on the liner while the carrier is permanently coated on opposite sides by the first and second adhesive layers. Preferably, the carrier is a relatively thin polypropylene film. Labels having varying advantages and characteristics may be formed by the following methods of forming labels utilizing the double coated tape as described above.

According to a first method, outserts or the like are placed on the second layer of adhesive. A layer of clear film laminate is then placed over the outsert and is secured to the tape along the portion of the second layer of adhesive not covered by the outserts. The construction is then die cut about the periphery of the outsert so that a border is formed adjacent to at least two sides of the outsert. The waste matrix is then removed. Because a laminate cover is provided, a non-coated and/or non-varnished printing stock may be used to form the outsert. Further, the laminate protects the booklet and provides greater integrity to the label.

According to a second method, the unwound, double coated tape is die cut through the carrier and both layers of adhesive to the release liner to form patches of the size (or smaller) and shape of the object to be carried thereon, e.g., an outsert. The unwanted portion of the tape or the waste matrix is then removed from the liner. The outserts or the like are then placed on the patches.

According to a third method, a deadening agent (a substance which removes the adherent property of adhesive) is applied to the exposed adhesive such that a portion of adhesive remains exposed. The outserts are placed on the exposed portion of the second layer of adhesive. The tape is then die cut, leaving a border around the outsert, through the two adhesive layers and carrier down to the liner and the waste matrix is removed. It will be appreciated that the "deadened" adhesive will not cause binding when the strip of labels is wound.

It is an object of the present invention to provide a label of the type including an outsert or leaflet having a pressure sensitive adhesive backing.

It is another object of the present invention to provide a label of the type described which creates a unitary construction which carries both the primary label and the information normally carried separately on an insert or outsert.

It is an object of the present invention to provide a method for forming a label as described above.

It is an object of the present invention to provide a label as described above, which does not require the application of adhesive to the label or the leaflet.

It is an object of the present invention to provide a method as described above which is cost effective and convenient.

It is an object of the present invention to provide a label as described above which may also include a laminate cover and a method for forming the same.

BRIEF DESCRIPTION OF THE DRAWINGS

FIG. 1 is a perspective view of a first embodiment according to the present invention.

FIG. 2 is a side elevational view of a section of the double coated tape of the present invention.

FIG. 3 is a perspective of a typical type of outsert intended for use in the preferred embodiment of the present invention.

DETAILED DESCRIPTION OF THE INVENTION

Figure 5:
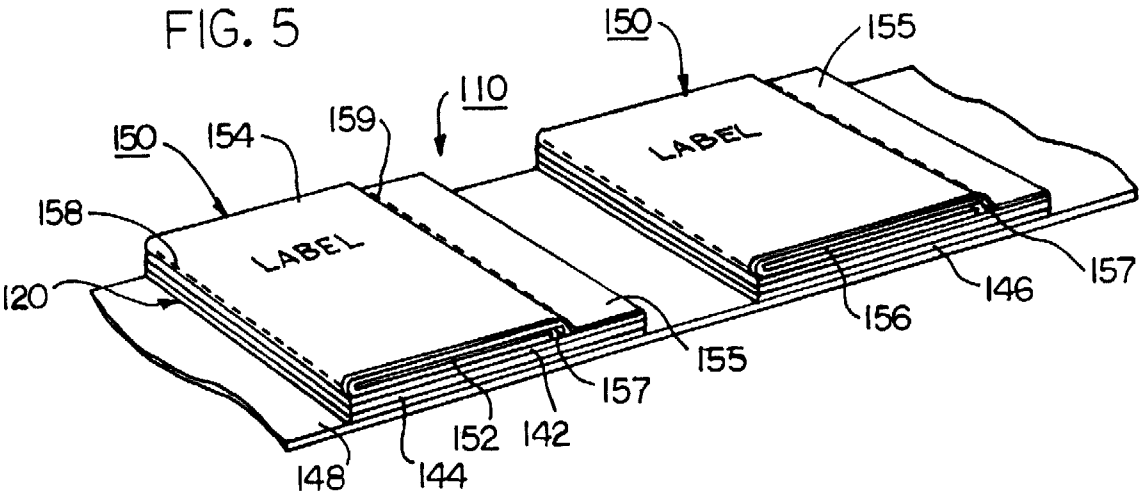
FIG. 5 is a perspective view of a second embodiment of the present invention.
Figure 7:
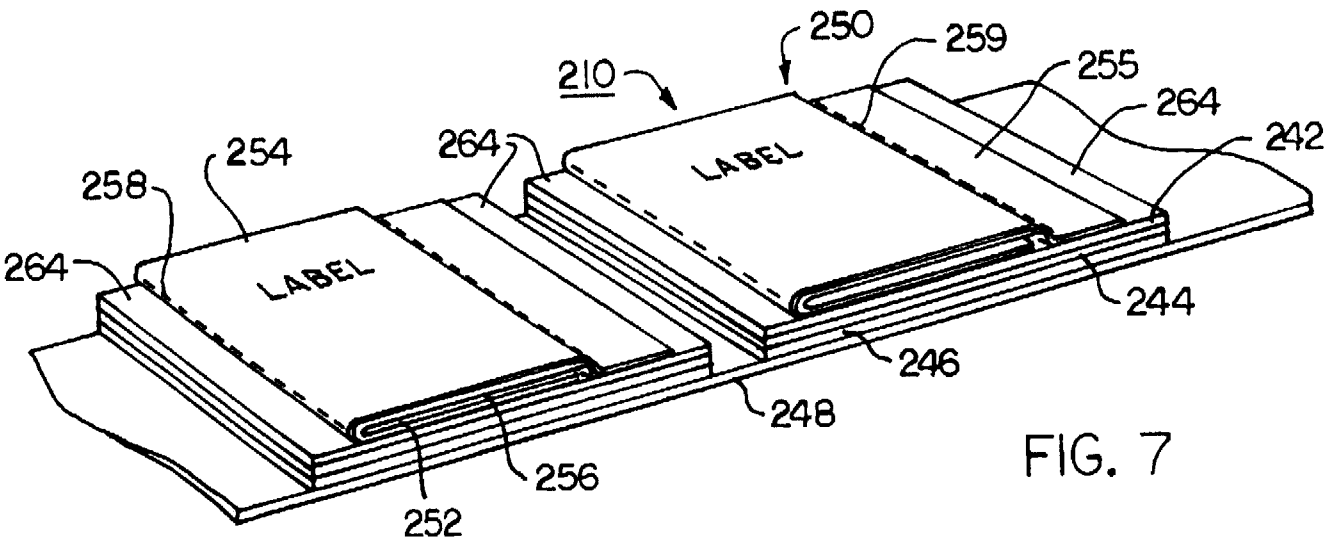
FIG. 7 is a perspective view of a third embodiment according to the present invention.

Referring now to FIGS. 1, 5, and 7, first, second, and third embodiments of the present invention, respectively, are shown therein. Label 10 of FIG. 1 includes a film laminate cover. Label 110 of FIG. 5 is unlaminated and is formed without a border surrounding the outsert. Label 210 of FIG. 7 is likewise unlaminated but includes a border 264 surrounding the outsert in which the adhesive has been removed.

As used herein, the term "outsert" means any type of outsert, leaflet, sheet or the like for carrying information thereon and/or serving as a primary label.

The unique aspect of the present invention resides in the use of the double coated tape 40 to which the outserts or leaflets are affixed and the manner in which the labels are produced. The double coated tape 40 is best seen in FIG. 2. Tape 40 includes liner 48, first adhesive layer 46, carrier 44, and second adhesive layer 42. Adhesive layers 46, 42 are preferably formed from pressure sensitive adhesive. Carrier 44 is preferably formed from a polypropylene substrate having a thickness of between 0.5 mil (0.0005 inch) and 4.5 mils (0.0045 inch). Double coated tape such as 3M Scotch Brand tape product number 9458 is exemplary of one product which may be used. Double coated tapes having a second release liner layer located on second adhesive layer 42 may also be used. Note that the relative size of the tape and thickness of the layers has been exaggerated in the drawings for the sake of clarity. Preferably, layers 42, 44, 46 which remain with label 10 when the same is removed from liner 48 will appear as a thin adhesive film on the lower surface of bottom panel 56.

Referring now to FIGS. 1–4 in general and to FIG. 1 in particular, a first and preferred embodiment of the label of the present invention, generally denoted 10, is shown therein. Label 10 includes a supporting patch 22 formed from the polypropylene layer 44, which is releasably secured to release liner 48, and outsert 50 which is secured to the top of patch 22. Laminate cover 60 covers both outsert 50 and its support patch 22.

Outsert 50, as best seen in FIG. 3, is preferably of the type disclosed in U.S. Pat. No. 5,263,743. However, it will be appreciated that other types of outserts, leaflets, sheets and the like may be used. Outsert 50 includes bottom panel 56, title panel 54, marginal edge portion 55, and intermediate panels 52. Tear lines 57 and 58 are provided between bottom panel 56 and panels 52 and 54, respectively. Tear line 59 is provided between panel 54 and marginal edge portion 55. Bottom panel 56 and the inner surface of marginal edge portion 55 are adhered to second adhesive layer 42. Depending on the application, outserts may be used which do not have marginal edge portion 55 and/or one or more of tear lines 59, 58, and 57. If marginal edge portion 55 is not used, it may be preferable to apply adhesive between the underside of panel 54 and the mating surface of panel 52. Statutory information may be printed on panels 54, 56, or borders 62, 264 (as described below) and/or the laminate cover.

Patch 22 is somewhat larger than outsert 50, thereby forming borders 62. Film layer 60 is formed by a preferably clear film secured to patch 22 along the peripheral portion of second adhesive layer 42 located in borders 62. Preferably, laminate 60 does not have adhesive on its inner surface so that it covers outsert 50 without adhering to the same. Laminate 60 serves to protect outsert 50 from damage during handling of the package. Laminate 60 is provided with a perforation 61 to facilitate access to the outsert.

Figure 4:
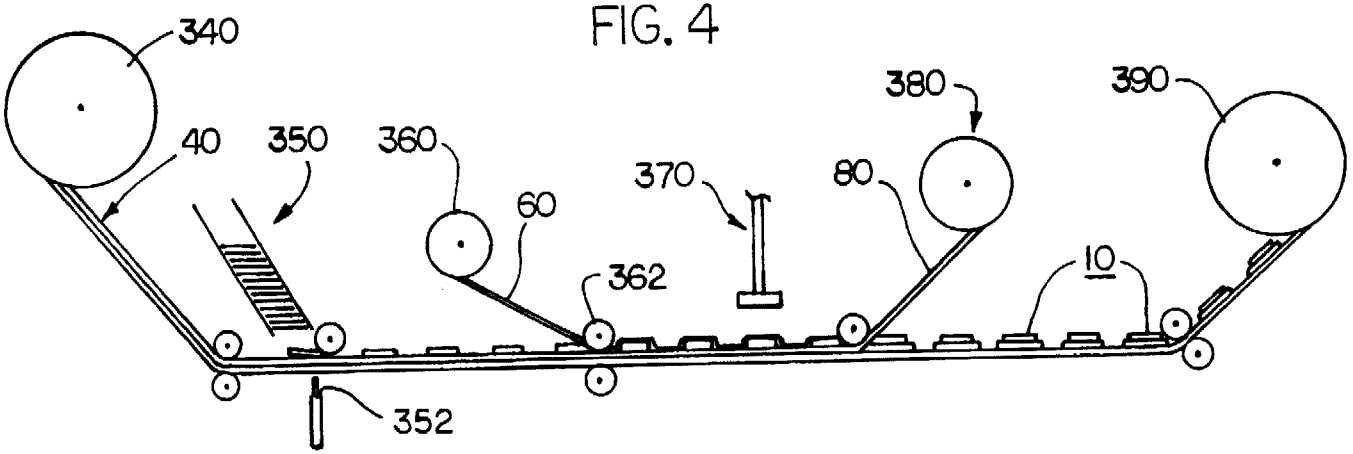
FIG. 4 is a diagrammatic side elevational view of an apparatus adapted to produce the labels of FIGS. 1–3.

Label 10 according to the first embodiment may be constructed as follows and with reference to FIG. 4. A continuous strip of tape 40 is removed from a roll, or unwinding station 340 as described above such that second adhesive layer 42 faces upwardly. A succession of outserts 50 are fed from a supply hopper or outsert applying station 350 at spaced intervals along tape 40. Station 350 preferably applies outserts in response to photodetector 352 whose eye senses marks previously printed on the release liner. These marks may be printed after the roll is unwound using a printing station (not shown). A continuous layer of film 60 is fed from a supply roll or laminate applying station 360 over second adhesive layer 42 and outserts 50. It will be appreciated that laminate 60 will be adhered to the portion of adhesive layer 42 not covered by an outsert 50. Tape 40, laminate 60, and outsert 50 are then passed through nip rollers 362 to secure the assembly. A die cutter 370 forms perforation 61 in laminate 60 and a cut line framing each outsert. Perforation 61 goes only through the lamination. The cut line extends down through both adhesive layers 42, 46 and through carrier 44 to release liner 48. The cut line is preferably spaced from the edges of outsert 50 such that borders 62 are formed on all four sides. Following the cutting operation, the resulting waste matrix 80 (i.e., those portions of layers 42, 44, 46, 50 not within the periphery of the cut lines) is removed from the construction at removal station 380. Upon removal of the waste matrix, labels 10 remain on release liner 48. The release liner and labels may be wound onto a take-up roll or winding station 390 or fan-folded into a stack. The finished web may be slit longitudinally if desired to form, for example, a four wide or "four-up" label roll into four separate label rolls. It will be appreciated that because all of second adhesive layer 42 has been either removed or covered by laminate 60, the liner and labels may be subsequently unwound for use without binding. It will be appreciated from the foregoing that the method as described allows a margin of error for placement of the outsert and location of the die cut.

A label 110 according to a second embodiment of the present invention, best seen in FIG. 5, is formed without the use of a laminate cover. The numerals 158, 154, 150, 159, 155, 146, 144, 142, 152, 156, 148 and 157 indicate elements which correspond to elements 58, 54, 50, 59, 55, 46, 44, 42, 52, 56, 48, and 57, respectively, of the first embodiment. Label 110 includes a patch 120 identical to patch 22 of the first embodiment except that patch 120 is sized and shaped to fit at or within the periphery of outsert 150. It will be appreciated that because outsert 150 covers all of the second adhesive layer 142 of patch 120, the liner and labels may be rolled and unrolled without binding.

Figure 6:
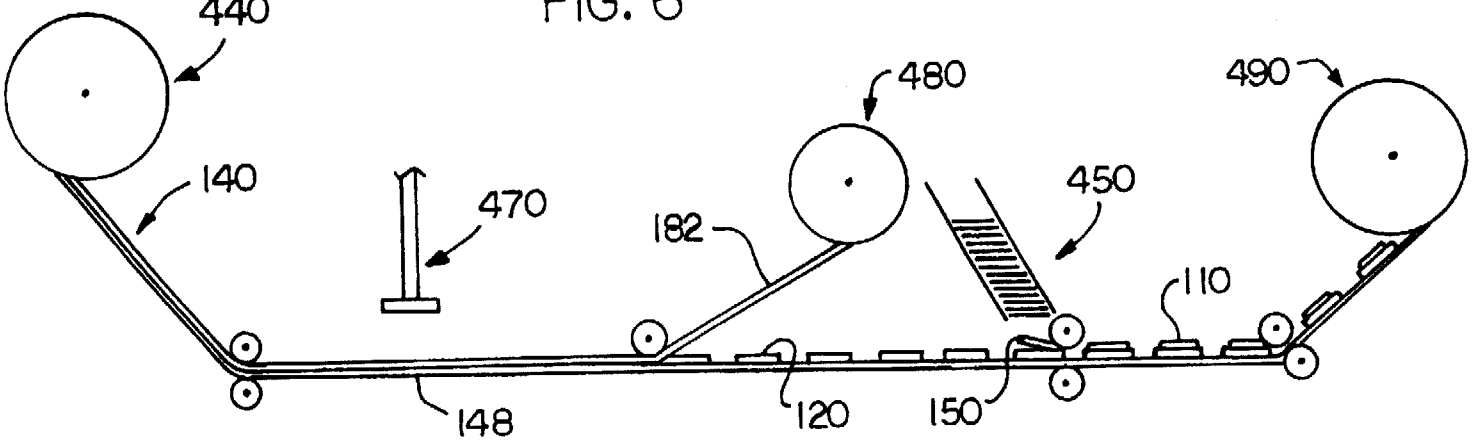
FIG. 6 is a diagrammatic side elevational view of an apparatus adapted to produce the labels of FIG. 5.

Labels 110 of the second embodiment may be constructed as follows and with reference to FIG. 6. Tape 140 is unwound from a roll at unwinding station 440. Tape 140 is die cut at cutting station 470 down to liner 148 and in the shape of patches 120. The resulting waste matrix 182 is then removed at removal station 480, leaving patches 120 on liner 148. As patches 120 pass under outsert applying station 450, outserts 150 are successively placed thereon whereby they are adhered to second adhesive layer 142. Resultant labels 110 may then be wound onto a roll by winding station 490 or fan-folded into a stack. The order of steps as described above is preferred because it requires less exact placement of the cut lines. That is, patch 120 may be cut smaller than the area of outsert 150 to allow for error in the placement of outsert 150.

Labels 210 according to a third embodiment of the present invention, as best seen in FIG. 7, may be formed without a laminate cover while still providing a patch 222 which extends beyond the periphery of outsert 250. The numbers 258, 254, 250, 259, 255, 256, 242, 244, 246, 248, 252, and 222 indicate elements which correspond to elements 58, 54, 50, 59, 55, 56, 42, 44, 46, 48, 52 and 22, respectively, of the first embodiment. Label 210 includes patch 222 which is larger than outsert 250 such that borders 264 extend beyond the edges of outsert 50. The portions of second adhesive layer 242 which make up borders 264 are treated with a deadening agent such that they are no longer adherent. Deadening agents suitable for this purpose include product number FM1512 from K&W Printing, Inc., of Franklin Park, Ill. It will be appreciated that labels 210 mounted on release liner 248 may be rolled and unrolled without binding because no adherent adhesive is exposed.

Figure 8:
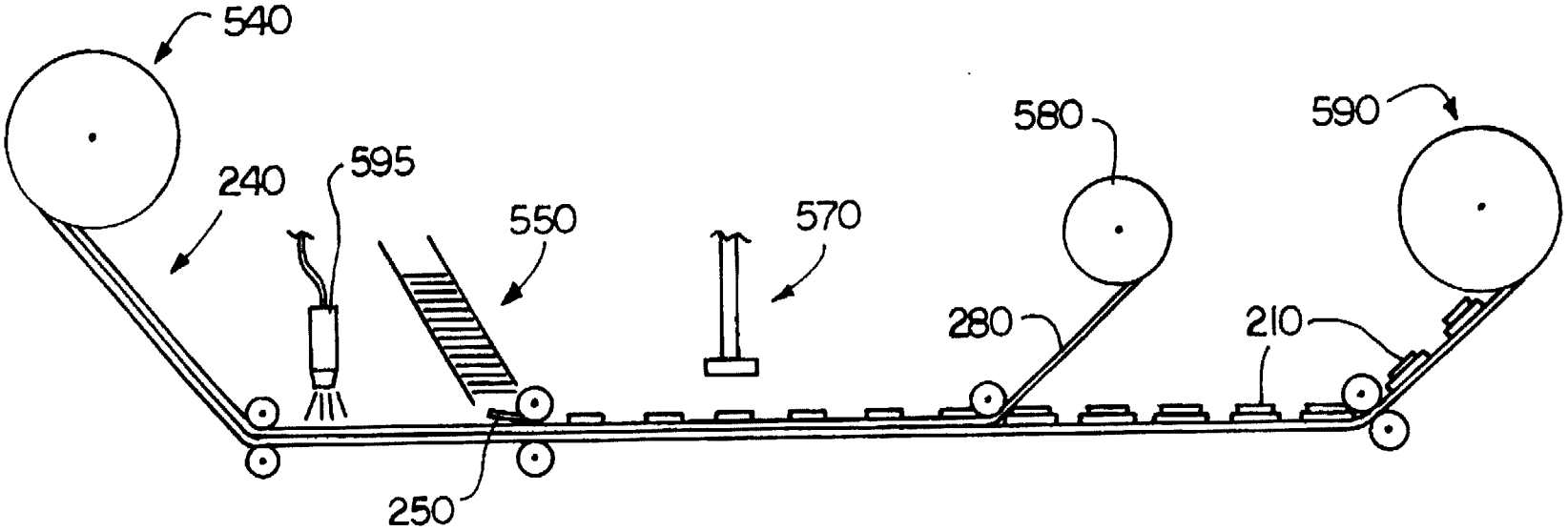
FIG. 8 is a diagrammatic side elevational view of an apparatus adapted to produce the labels of FIG. 7.

Labels 210 according to the third embodiment may be formed as follows and with reference to FIG. 8. A continuous strip of tape 240 is unwound from a supply roll at unwinding station 540. A deadening agent is applied onto the construction by coating station 595 such that a portion of non-deadened adhesive remains exposed. Outserts 250 are then successively applied to the non-deadened adhesive on the upper surface of tape 240 at outsert applying station 550. At cutting station 570 die cuts are formed around each outsert 250 down to liner 248 such that borders 264 are formed thereabout. Alternatively, the cutting step may take place prior to the application of the outsert. The resultant waste matrix 280 is removed at removal station 580. The resulting labels 210 and liner 248 may then be rolled onto a roll by winding station 590 or fan folded into a stack. It will be appreciated from the foregoing that the method as described provides a margin of error for locating the outserts and the cut lines.

It will be appreciated that in each of the methods described above, if a double coated tape of the type having a second release liner is used, the second liner will be removed as a part of the unwinding step.

Certain modifications and improvements will occur to those skilled in the art upon a reading of the foregoing description. It should be understood that all such modifications and improvements have been deleted for the sake of conciseness and readability, but are properly within the scope of the following claims.

What is claimed is:

1. A label product, comprising:

(a) a web of double coated tape, said web including:

(i) a carrier formed from a polymeric film having a thickness of between 0.5 mil and 4.5 mils and an upper surface and a lower surface;

(ii) a silicone coated release liner having an upper surface;

(iii) said lower surface of said carrier permanently coated with a first adhesive layer and said upper surface of said carrier permanently coated with a second adhesive layer;

(iv) said carrier releasably secured to said upper surface of said release liner by said first adhesive layer; and (b) a plurality of outserts affixed at spaced positions along said web, each of said outserts having a bottom panel, said bottom panel of said outsert secured to said upper surface of said carrier by said second adhesive layer.

2. The label product of claim 1 further including a laminate cover covering each of said outserts and secured to said upper surface of said carrier by said second adhesive layer.

3. The label product of claim 2 wherein said laminate is secured to said second adhesive layer by a border of adhesive formed about each of said outserts.

4. The label product of claim 1 wherein at least a portion of said second adhesive layer is not covered by said outserts and substantially all of said uncovered portion is coated with an adhesive deadener, said adhesive deadener being exposed to provide a substantially non-tacky border about each outsert.

5. The label product of claim 1 wherein substantially all of said second adhesive layer is covered by said outserts.

6. The label product of claim 4 wherein each of said borders comprises a transverse strip extending across said release liner between adjacent outserts, each of said outserts including a folded edge and each of said transverse strips disposed adjacent said folded edge of a respective outsert.

7. The label product of claim 1 wherein said polymeric film is a polypropylene film.

8. A label product, comprising:

(a) a web of double coated tape, said web including:

(i) a carrier having a thickness of between 0.5 mil and 4.5 mils and an upper surface and a lower surface;

(ii) a silicone coated release liner having an upper surface;

(iii) said lower surface of said carrier permanently coated with a first adhesive layer and said upper surface of said carrier permanently coated with a second adhesive layer;

(iv) said carrier releasably secured to said upper surface of said release liner by said first adhesive layer;

(b) a plurality of outserts affixed at spaced positions along said web, each of said outserts having a bottom panel, said bottom panel of said outsert secured to said upper surface of carrier by said second adhesive layer; and (c) wherein at least a portion of said second adhesive layer is not covered by said outserts and substantially all of said uncovered portion is coated with an adhesive deadener, said adhesive deadener being exposed to provide a substantially non-tacky border adjacent each outsert.

9. The label product of claim 8 wherein each of said borders comprises a transverse strip extending across said release liner between adjacent outserts, each of said outserts including a folded edge and each of said transverse strips disposed adjacent said folded edge of a respective outsert.

* * * * *